United States Patent [19]

Selvia et al.

[11] 3,985,267

[45] Oct. 12, 1976

[54] LOGIC AND SELECTOR CIRCUITRY FOR FLAVORED-BEVERAGE DISPENSING APPARATUS

[75] Inventors: Ray E. Selvia; Allan D. Barden, both of Terre Haute, Ind.

[73] Assignee: All State Vending Equipment, Inc., Terre Haute, Ind.

[22] Filed: Oct. 2, 1974

[21] Appl. No.: 511,288

[52] U.S. Cl. ..... 222/70; 222/129.4

[51] Int. Cl.[2] ..... B67D 5/56

[58] Field of Search ..... 222/70, 144.5, 145, 222/129.1–129.4; 194/13

[56] References Cited

UNITED STATES PATENTS

| | | | |
|---|---|---|---|
| 2,118,704 | 5/1938 | Grontkowski | 222/144.5 X |
| 2,776,074 | 1/1957 | Laurence | 222/129.4 X |
| 2,840,274 | 6/1958 | Arnett et al. | 222/129.4 X |
| 2,848,140 | 8/1958 | Gabrielsen | 222/129.4 X |
| 2,880,912 | 4/1959 | Fisher | 222/129.4 |
| 2,925,835 | 2/1960 | Mojonnier et al. | 222/70 X |
| 2,961,127 | 11/1960 | Reynolds et al. | 222/129.4 X |
| 3,297,061 | 1/1967 | Nimee | 222/129.4 X |
| 3,348,737 | 10/1967 | Yingst et al. | 222/129.1 X |

*Primary Examiner*—Robert B. Reeves
*Assistant Examiner*—Joseph J. Rolla
*Attorney, Agent, or Firm*—Woodard, Weikart, Emhardt & Naughton

[57] ABSTRACT

Logic and selector circuitry control the fluid flows in a flavored-beverage dispensing apparatus of the type which dispenses a beverage of a flavor selected from a plurality of flavors. The logic circuitry includes a control for the carbonated and still water supply system of the apparatus which guarantees that still water will be directed to a beverage container at the output of the apparatus even during a period when the carbonator would ordinarily be refilling with still water. The selector system of the apparatus includes a printed circuit board having a slide switch mounted thereon operable to couple electrical power to a conductive pad in each of two sets of conductive pads which are preset to determine the flavor and carbonation, if any, of the beverage selected by positioning the slide switch.

10 Claims, 4 Drawing Figures

LOGIC AND SELECTOR CIRCUITRY FOR FLAVORED-BEVERAGE DISPENSING APPARATUS

BACKGROUND OF THE INVENTION

1. Field of the Invention

The present invention is in the field of systems for beverage dispensing apparatus.

2. Description of the Prior Art

In the past, the control of fluid flow and beverage selection in a beverage dispensing apparatus has been provided generally by relatively complex systems of electromechanical devices. Such devices are expensive and create maintenance and repair problems due to field failures. It would be particularly advantageous to minimize the electromechanical parts in the beverage selector system since this portion of the beverage dispensing apparatus most often calls for routine changes and adjustments by the personnel servicing the dispensing apparatus and also is most frequently subject to contact by the public.

Also in the past, beverage apparatus having provision for dispensing both carbonated and uncarbonated beverages have suffered from the problem of incomplete still water filling in a still water beverage during the time period when the carbonator in the apparatus is also receiving water from the still water supply. It has also proved difficult in the prior art to obtain consistently the proper cycle timing for the syrup pumps associated with the various syrup supplies within the beverage dispensing apparatus.

SUMMARY OF THE INVENTION

One embodiment of the present invention is, in a carbonated and still water flavored-beverage dispensing apparatus having syrup supply means for dispensing syrup into a beverage container and water supply means for dispensing water into the beverage container, the improvement which comprises water supply means including a carbonator having an input for still water and a carbonated water output, a first conduit coupled to the input of the carbonator, still water supply means for coupling still water through the first conduit to the carbonator input to maintain the water level in the carbonator, and priority means for interrupting still water flow in the first conduit and for diverting the still water flow to the beverage container during the dispensing of a beverage containing still water.

Another embodiment of the present invention is, in a flavored-beverage dispensing apparatus having syrup supply means for dispensing a pre-determined amount of a selected syrup into a beverage container for each beverage dispenses and water supply means for dispensing a pre-determined amount of water into the beverage container for each beverage dispensed, the improvement which comprises syrup supply means including a plurality of syrup containers each containing a different syrup, a plurality of syrup pumps, each syrup pump having an inlet coupled from a different syrup container of the plurality of syrup containers and having an outlet coupled to a location adjacent the beverage container, and cycle timer and selector means for activating the syrup pump of the plurality of syrup pumps associated with the selected syrup at a predetermined time relative to the time of dispensing of water by the water supply means, said predetermined relative time being different for different pumps of the plurality of syrup pumps.

Still another embodiment of the present invention is, in a flavored-beverage dispensing apparatus having means for dispensing a beverage of a flavor selected from a plurality of flavors and having selector means for selecting the flavor of the beverage to be dispensed, the improvement which comprises selector means including a circuit board mounted in the apparatus having a first conductive path coupled from a source of electrical power and having a plurality of conductive pads separate from the first conductive path, selector switch means for selectively coupling the first conductive path to a pad of the plurality of conductive pads, and a plurality of conductive arms, each conductive arm having a first end coupled to a different pad of the plurality of conductive pads and having a second end coupled through a conductive path on the board to a pump in a beverage dispensing means associated with the flavored-beverage selected.

It is an object of the present invention to provide still water supply means for a carbonated and still water flavored-beverage dispensing apparatus which includes priority means for guaranteeing still water flow for a still water beverage being dispensed even during a time period when the carbonator in the apparatus is being refilled.

It is a further object of the present invention to provide a flavored-beverage dispensing apparatus having a plurality of syrup pumps and also having means for activating each pump at a predetermined time relative to the time of dispensing of water by the apparatus.

It is a still futther object of the present invention to provide a flavored-beverage dispensing apparatus which has a beverage selector means including a presettable circuit board which does not utilize electromechanical devices.

Further objects and advantages of the present invention shall be apparent from the following detailed description and accompanying figures.

DESCRIPTION OF THE PREFERRED EMBODIMENT

Figure 1:
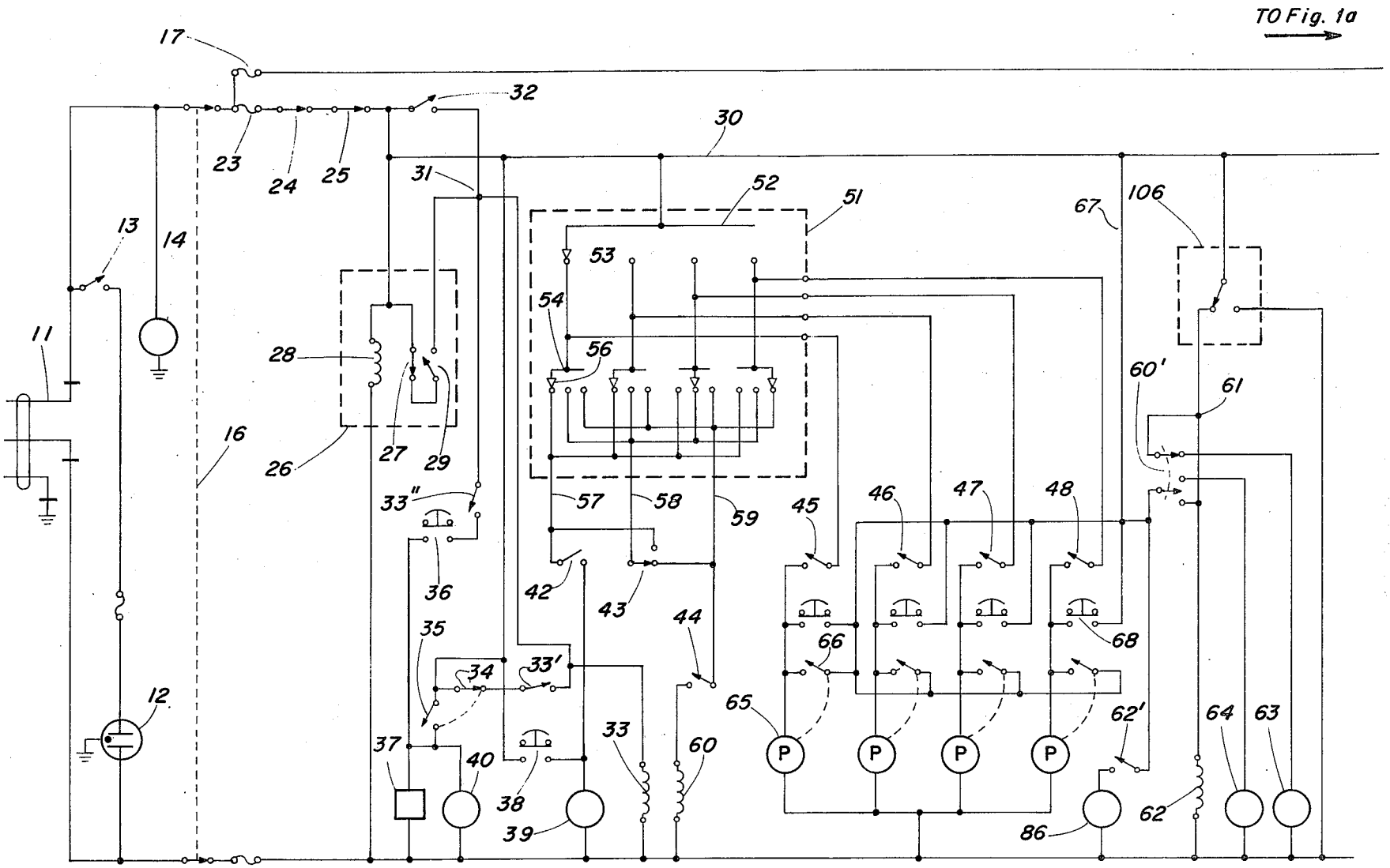
FIGS. 1 and 1*a* are schematic diagrams of the control circuitry of an embodiment of the present invention.
Figure 1A:
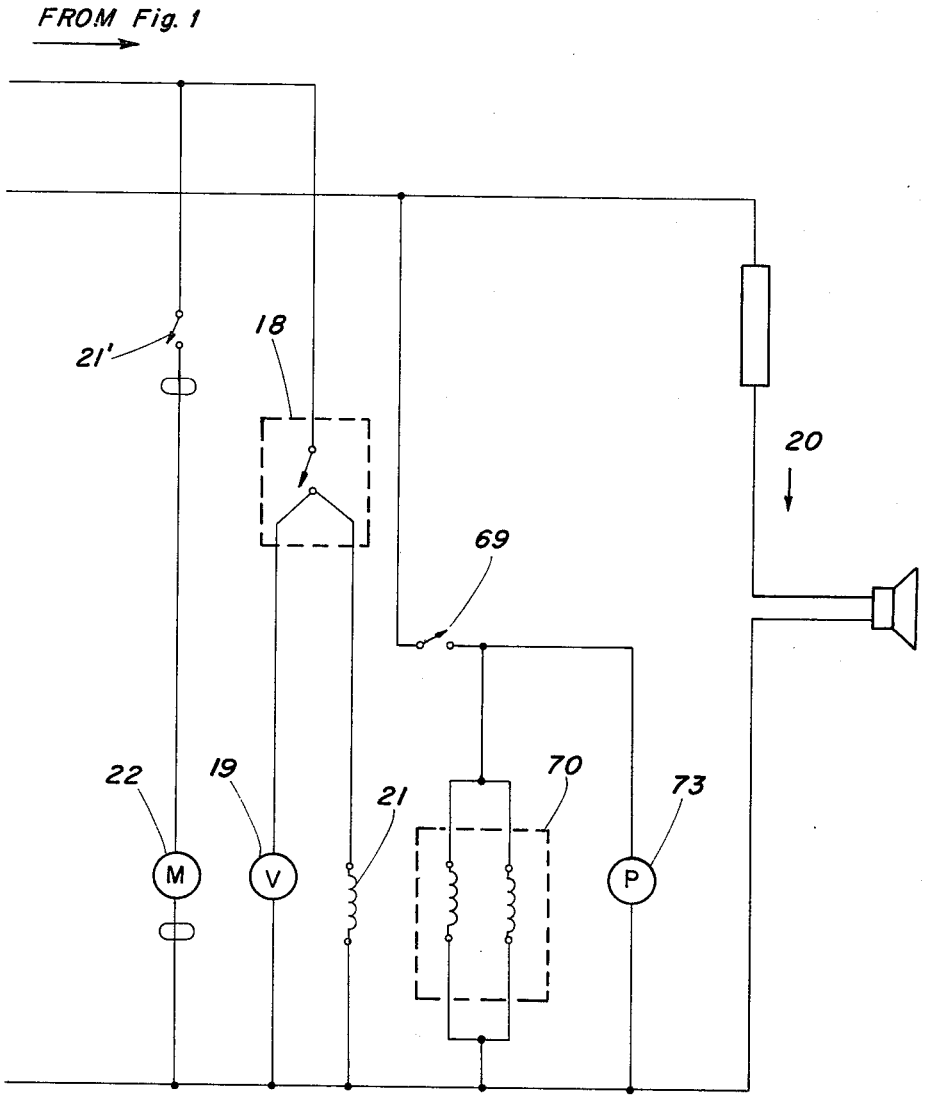

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would noramlly occur to one skilled in the art to which the invention relates.

Referring in particular to FIG. 1, there is shown a schematic diagram of the selector and logic control circuitry for a flavored-beverage dispensing apparatus which includes means for dispensing beverages containing still water, carbonated water or a mixture of both. Beginning at the left of FIG. 1, there is shown a standard power source 11 for the circuitry together with a service outlet 12 connected through service outlet switch 13. A polarity light 14 for power input 11 is provided, and points beyond this preliminary circuitry are coupled through double pole master switich 16.

Figure 2:
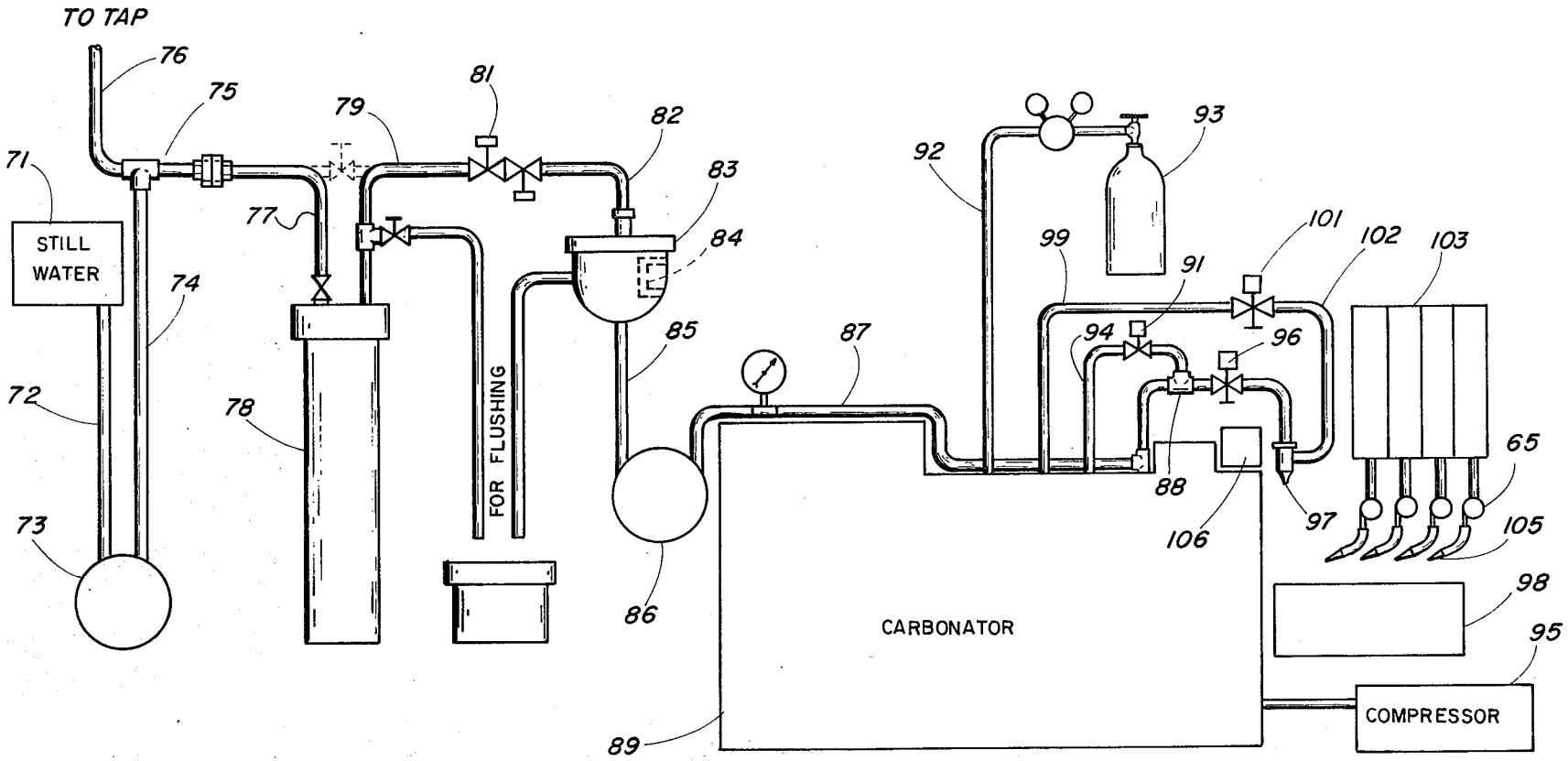
FIG. 2 is a block diagram of the fluid flow of the embodiment of FIG. 1.

Before proceeding with a description of the circuitry of FIG. 1, reference is now made to FIG. 2 showing the fluid flow fo the beverage dispensing apparatus in block diagram form in order to facilitate understanding the electrical circuitry of FIG. 1. The particular apparatus shown in FIG. 2 is designed to provide still water, carbonated water or a combination of both together with one of four types of syrup to make a flavored beverage. The elements shown in FIG. 2 are conveniently mounted within an openable cabinet which may include a locking door and which provides water and syrup mixtures in dispensed containers accessible from outside the cabinet.

Beginning at the left of FIG. 2, there is shown a still water reservoir 71, which maybe a jug or other water container, from which still water is coupled through conduit 72 by water pump 73, and thence through conduit 74 to junction 75. The other input to junction 75 is pipe 76 from a source of tap water. Still water supply 71 and water pump 73 are optional as an auxiliary water supply system to augment the supply of tap water. Water from either conduit 74 or 76 flows through conduit 77 and water filter 78 to conduit 79 and double inlet valve 81. If dual inlet valve 81 is open, the water flow is through conduit 82 into feeder tank 83. Within feeder tank 83 is located feeder tank switch and low water shutoff switch apparatus 84. Water from feeder tank 83 is pumped through conduit 85 by water pump 86 and through conduit 87 to junction 88. Conduit 87 is preferably routed thorugh carbonator 89 to take advantage of the cooling therein but has been shown external to carbonator 89 to clarity in FIG. 2.

One path from junction 88 is through carbonator fill valve 91 to replenish the supply of water in carbonator 89 when the valve is open. Carbonator 89 also receives carbon dioxide through line 92 from carbon dioxide source 93. The carbonator 89 has an inner portion containing the carbonated water obtained from the combination of carbon dioxide through line 92 and still water through valve 91 and conduit 94. Carbonator 89 also includes an outer jacket which includes cooling coils operated by compressor 95.

The other still water path from junction 88 is through still water valve 96, if it is open, and then through nozzle 97 into a beverage container shown diagrammatically at 98. The other input to nozzle 97 is carbonated water from the carbonator 89 which flows through conduit 99, carbonated water valve 101 and conduit 102. The appropriate control of valves 91, 96 and 101 provide the appropriate still and/or carbonated water flow through nozzle 97, as shall be described more particularly hereinafter in regard to the circuit diagram of FIG. 1. Also shown diagrammatically in FIG. 2, are the various syrup supplies such as 103, each of which is coupled through a pump 65 to a nozzle 105 and thence, into container 98. The control circuitry for the syrup pumps 65 shall also be discussed in more detail in regard to FIG. 1.

Referring back to FIG. 1, if master switch 16 is closed, power is coupled to two branches, the first of which is through fuse 17 providing power for the cooling system and compressor 95 (FIG. 2). A temperature control switch 18 is provided in the outer jacket of carbonator 89 and switch 18 closes if the temperature exceeds a preset level. When switch 18 closes, refrigeration valve 19 is energized to open and control coil 21 is also energized. Energizing control coil 21 closes switch 21', energizing coolant compressor motor 22.

The power for the balance of the control circuitry of FIG. 1 is provided through fuse 23 in the other branch from master switch 16. Power is coupled through a low water level shutoff switch 24 which is located in unit 84 in feeder tank 83 of FIG. 2. Switch 24 is operable to open if the water level in the feeder tank falls below a preset level. Power is also coupled through waste bucket switch 25 which is normally closed but opens if the waste bucket (not shown) located beneath an apertured platform supporting container 98 is filled with liquid.

To initiate the dispensing of a beverage, coin mechanism 26 is provided. If power is on, the current flow in coil 28 maintains switch 27 in a closed position, This allows power to be coupled to coin mechanism vend switch 29, which closed by the insertion of the appropriate coins in the coin mechanism by a purchaser. The insertion of coins couples power to point 31, which may also be energized by the closing of free vend switch 32, which is provided in addition to coin mechanism 26. Alternatively, if the beverage dispensing apparatus is not to be operated for coin vending, only free vend switch 32 may be provided and coin mechanism 26 eliminated.

Once point 31 is energized, power is coupled through vend relay 33. Energization of vend relay 33 closes contacts 33' and 33'' associated with relay coil 33. Closing contacts 33' couples power from bus 30 through normally closed switch 34 to coil 33 maintaining the energization of relay coil 33. Closing contacts 33'' energizes one side of vend switch 36 which is closed by the operator of the apparatus after he has selected the beverage he desires on the selector board, as shall be described more particularly hereinafter. Closing vend switch 36 advances vend counter 37 and energizes cycle timer 40. Cycle timer 40 controls eight timed switches, the opening and closing of which is preset at cycle timer 40.

Dual switch 41 is in the position shown in FIG. 1 before energization of cycle timer 40. After cycle timer 40 is energized, dual switch 41, effectively a full cycle switch, is moved by cycle timer 40 so that contacts 35 close and contacts 34 open. Opening contacts 34 removes the self-latching current from bus 30 to vend relay coil 33, so that the contacts 33' and 33'' will reopen once power is no longer coupled through coin mechanism switch 29 or free vend switch 32.

Closing contacts 35 of timed switch 41 couples power directly from bus 30 to cycle timer 40, which will remain energized until the end of the cycle when contacts 35 again open. This enables cycle timer 40 to remain energized for the entire cycle and to appropriately open and close the remaining switches 42 through 48, which are controlled by timer 40. The switches 42, 43 and 44, controlled by cycle timer 40 are associated with the still water and carbonated water dispensing system of the apparatus. To understand the functioning of these switches, the operation of selector board 51 will first be discussed.

Power is coupled from bus 30 to conductive strip 52 on selector board 51 and slidable conductor contacts 53 couple power from strip 52 to a selected syrup pump line associated with timed switches 45 through 48. Selector 53 ispositionedby the operatorof the beveragedispensing apparatus before closing vend switch 36 to initiate operation of the beverage dispenser. The operation of the appropriate syrup pump line activated as indicated above shall be discussed hereinafter in more detail.

The positioning of selector switch 53 also energizes one of a plurality of pads on selector board 51 such as pad 54. Each pad 54 has an associated water selector switch such as 56 associated therewith, movable to couple energy from pad 54 to one of the three lines 57, 58 or 59. It can be seen that each of these conductive pads 54, regardless of which syrup pump circuit it is connected to, also provides power through a selector switch such as 56 to one of the three water selector control lines.

After cycle timer 40 is activated, times switch 42 closes for essentially the entire cycle as does times switch 44. If selector switches 53 and 56 are positioned as shown in FIG. 1, power is coupled from bus 30 through the selector board, and through switch 42, to energize carbonated water valve control 39, opening crbonated water valve 101 (FIG. 2) and supplying carbonated water to nozzle 97. If selector switch 56 is in the extreme right-hand position rather than the left-hand position, the closing of timed switch 44 activates still water relay coil 60. As shown further to the right in FIG. 1, a pair of contacts 60' are controlled by still water relay coil 60.

Figure 3:
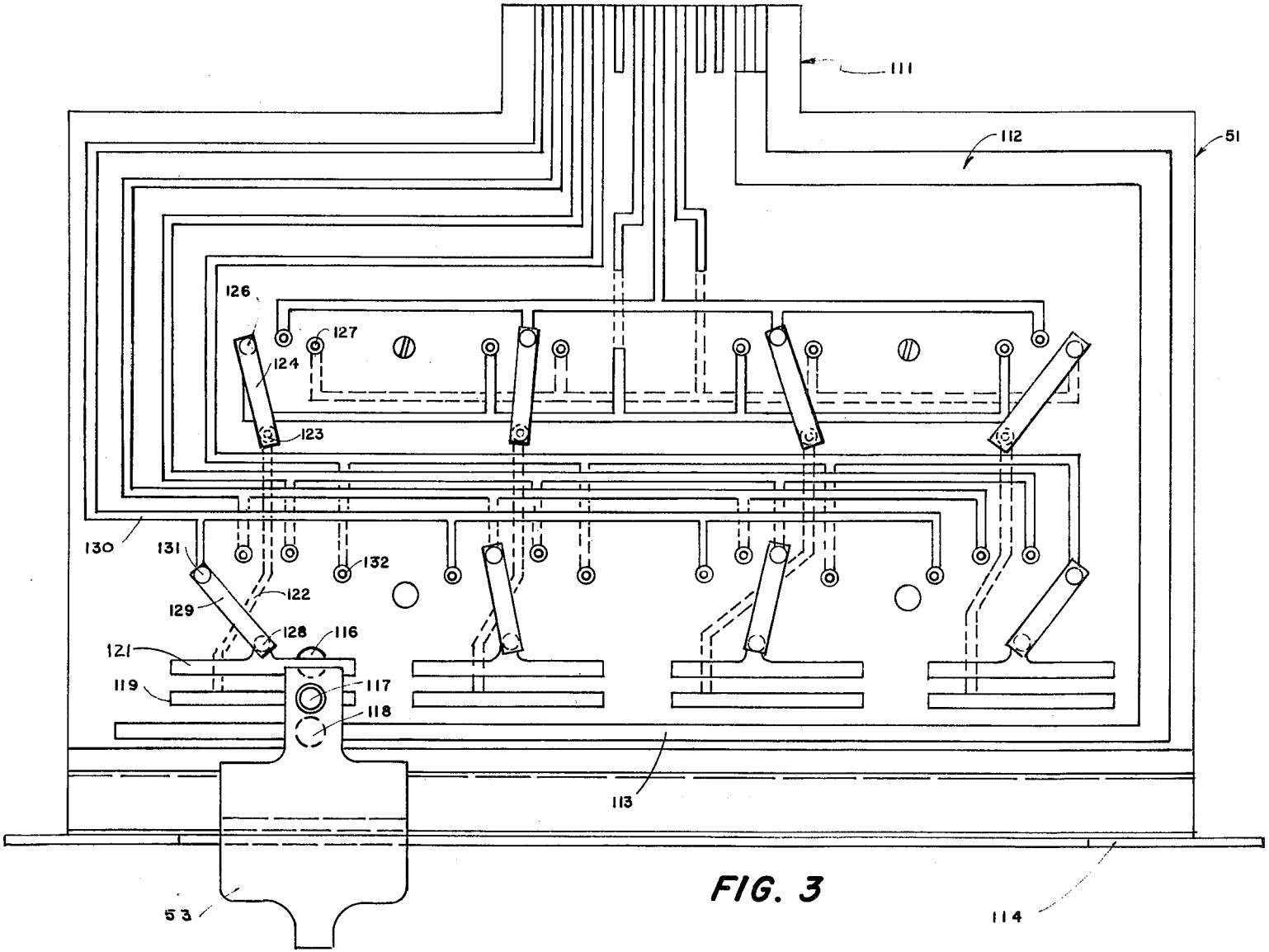
FIG. 3 is a top view of a selector board according to the embodiment of FIG. 1.

When still water relay coil is not activated, the contacts 60' are as shown in FIG. 1. In this position, a carbonator level control 106 (FIGS. 1 and 3) monitors the level of carbonated water in carbonator 89. If the carbonated water in carbonator 89 becomes lower than a preset amount, the switch in level control 106 closes to couple power to point 61 energizing water pump relay coil 62, closing water pump relay contacts 62' and energizing water pump motor 86 (FIGS. 1 and 3).

Energizing point 61 of the circuit also couples power to control 63 for opening carbonator feed valve 91 (FIG. 2). As shown in FIG. 2, water pump 86 pumps still water to junction 88 and, since valve 91 is open, still water is pumped into the carbonator to bring the water level back up to the desired level. Still water valve control 64 is at this time not energized, as shown in FIG. 1 and, as shown in FIG. 2, still water valve 96 is therefore closed to prevent water flow to nozzle 97.

Returning not to the situation where timed switch 44 is closed and water selector switch 56 is in the right-hand position energizing still water relay coil 60, still water relay contacts 60' swing to the left, as viewed in FIG. 1. The left-hand 60' contact couples power from bus 30 to point 61, and point 61 is thus energized whether or not power is being coupled through carbonator level control 106; and right-hand contact 60' removes power from the carbonator fill valve control 63, closing carbonator fill valve 91 (FIG. 2). The movement of the right-hand 60' contact simultaneously couples power to still water valve control 64, opening still water valve 96 (FIG. 2) permitting still water flow to nozzle 97. The energization of point 61 also, of course, energizes water pump relay 62, closing contacts 62', and energizing the water pump motor 86. The action of water pump motor 86, and the above-described valve settings, permit pumping still water from the feeder tank to nozzle 97, regardless of the conditions sensed by carbonator level control 106.

Returning once again to selector board 51, the remaining possible setting for the water selector switch 56 is the central position which couples power through lines 58 to timed switch 43. This setting for switch 56 is provided to permit a mixture, preferably in equal amounts, of still water and carbonated water in the beverage being supplied. Switch 43 is timed by cycle timer 40 to remain in the position illustrated in FIG. 1 for approximately 50% of a beverage-dispensing cycle, at which time switch 43 moves to couple power through timed switch 42. Thus, in this mode, a half cycle of each type of water is supplied in the same manner as was described for each of the entire cyles associated with timid switches 42 and 44.

The other output setting from selector board 51 is the customer controlled setting of beverage selector 53, which determines syrup selection. While water selector switches 56 are preset by the person maintaining the apparatus in order to provide the appropriate carbonation or noncarbonate for the beverages to be purchased, the syrup selector switch 53 is constrained to select the preset water choice, but switch 53 is the customer controlled selector as to flavor of the beverage to be dispensed. For example, as shown in FIG. 1, beverage flavor selector switch 53 couples power from bus 30 to timed switch 45. Each of the other switches 46 through 48 operate in the same manner as switch 45, therefore switch 45 only shall be described in detail. The timing of switch 45 is set at cycle timer 40. At the point in the cycle where cycle timer 40 closes timed switch 45, the power from bus 30 is coupled through selector board 51 to syrup pump 65. Timed switch 45 is closed for a short time and then reopens, with an integral full cycle timer associated with pump 65 closing full cycle switch 66 after initial energization of pump 65. Power for each full power switch, such as 66, associated with each of the syrup pumps is supplied from bus 30 through line 67.

The timing of the closing of timed switches 45 through 48 is determined by the viscosity of the syrup being pumped by the syrup pump such as 65 associated with the particular timed switch. Pump 65 is a piston and cylinder pump which, as stated above, goes through one full cycle upon being energized, and therefore, the timing of a cycle varies depending upon the viscosity of the syrup. The time at which a particular pump is energized by the closing of timed switches 45 through 48 is determined such that the final syrup is pumped through syrup nozzle 105 (FIG. 2) slightly before the final water is discharged from nozzle 97, in order to obtain optimum mixing of the beverage being dispensed. The timing for switches 45 through 48 is reset, if necessary, when syrups are changed.

A series of priming switches 68 are provided in the syrup pump circuitry for priming the syrup pumps upon installation of new syrup supply containers such as 103 (FIG. 2). Closing priming switch 68 couples power to its associated syrup pump initiating a full cycle to prime the pump.

In the water supply circuitry, there is also provided a flush switches 38 to energize carbonated water valve control 39 to open carbonated water valve 101 (FIG. 2) for flushing out the system. Also coupled from bus 30 is is feed tank switch 39, which is a portion of unit 84 in feeder tank 83 of FIG. 2. If the water level in feeder tank 83 falls below a certain level, not low enought to open the low water shutoff switch described above, switch 69 closes energizing control 70 for dual inlet valve 81 (FIG. 2) and also activating water pump 73 if still water supply 71 is being used as the source of still water. A ballast and light combination 20 are provided for illuminating customer control areas of the beverage dispensing apparatus, and other optional electrical equipment may be added as necessary.

Referring now to FIG. 3, there is shown circuit board 51 for the selector circuitry of FIG. 1. Board 51 is a double sided phenolic board including a plug-in portion 111 to be plugged into a socket in the beverage dispensing apparatus to couple the conductors on board 51 to those shown in FIG. 1. Conductive strip 112 is coupled through the plug-in portion to power bus 30 in the circuit of FIG. 1. The end of strip 112 away from the plug-in portion forms an energized strip at 113 along the front of the board. The board is mounted in the beverage dispensing apparatus at its front edge in a supporting bracket 114 which contains a slot for selector lever 53, which is slidably attached to board 51. Bracket 114 also contains indicia for four flavored beverages to be dispensed by the apparatus corresponding to the positioning of selector switch 53.

Terminals 116, 117 and 118 on selector switch 53 are electrically common, and as selector 53 is moved among the four positions shown in FIG. 3, contact 118 remains in contact with energized strip 113 and provides coupling from strip 113 to both contacts 116 and 117. The four foremost conductive pads such as 119 are for water selection. With selector 53 in the position shown in FIG. 3, power from strip 113 is coupled through terminals 118 and 117 to conductive pad 119. Energized conductive pad 119 is connected by path 122 on the bottom of board 51 to rivet 123. Riveted to board 51 by rivet 123 is a switch arm 124 having a brush contact 126 which may be positioned by rotating arm 124 to make electrical contact with one of the three pads such as 127. Each of the three pads such as 127 is coupled to a different one of three strips leading to plug-in portion 111 and corresponding to lines 57, 58 and 59 of FIG. 1, providing for energization of the appropriate valve controls to obtain a still water, carbonated water or mixed water beverage.

Each set of three pads such as 127, associated with each of the four beverage selections, may be set in the same manner by the person servicing the beverage dispensing apparatus so that the appropriate carbonation is supplied for the beverage whose indicium appears on bracket 114 and whose syrup pump will be activated by the positioning of selector switch 53.

The positioning of selector switch 53 also determines the syrup pump energized, and as shown in FIG. 3, energized contact 118 is electrically connected to contact 116 which is coupled to pad 121. Each of the four pads such as 121 disposed along board 51 operate in the same fashion so only the operation associated with pad 121 shall be discussed in detail. When pad 121 is energized, the electrical connection to rivet 128 energizes arm 129 and brush contact 131. Arm 129 may be pivoted about rivet 128 so that contact 131 makes electrical connection with one of the pads such as 132, in the same fashion as described above in regard to arm 124. With the arm 129 positioned as shown in FIG. 3, electrical power is coupled through arm 129 to one of four conductive strips 130 which are coupled to a different one of timed switches 45 through 48 (FIG. 1).

The plug-in board as shown in FIG. 3 eliminates the need for electromechanical devices to perform the selector function in a beverage dispensing apparatus as presently disclosed. The type of water, carbonated or still or a mixture of both, may be initially set by service personnel setting up the apparatus by merely positioning arms 124 for each beverage. Later changes of the beverages may be accomplished with ease by merely repositioning the levers such as 124. Similarly, the lever arms 129 may each be positioned for a different syrup to be pumped, as shown in FIG. 3, or more than one setting may be established for the energization of the same pump to provide the same beverage at more than one position or the same syrup with differences in carbonation at two or more positions.

While there have been described above the principles of this invention in connection with specific apparatus, it is to be clearly understood that this description is made only by way of example and not as a limitation of the scope of thee invention.

What is claimed is:

1. In a flavored beverage dispensing apparatus having means for dispensing a beverage selected from a plurality of beverages, each of said beverages containing a preset flavor and water type, the improvement which comprises:

a. syrup pump means for supplying syrup associated with the flavor of the selected beverage, said syrup pump means being operable to supply a different syrup of the plurality of syrups when activated;

b. water pump means for supplying the type of water for the selected beverage, said water pump means being operable to supply one of several different water types when activated;

c. a selector;

d. circuit board means engaged with said selector and having a plurality of conductive paths with which said selector is operatively associated, each conductive path of the plurality of conductive paths corresponding to a different beverage of the plurality of beverages selected from;

1. each said conductive path including a first conductor coupled to said syrup pump means for the beverage for that conductive path and 2. each said conductive path having a second conductor coupled to said water pump means for the beverage for that conductive path, 3. said selector being operable to couple electrical power to the first and second conductor at each said conductive path of the plurality of conductive paths activating said syrup pump means and water pump means for that conductive path; and e. presetable cycle means associated with each said syrup pump means for adjustably setting the timing of a cycle for said syrup pump means.

2. The apparatus of claim 1 in which the syrup pump means dispense a predetermined amount of a selected syrup into a beverage container for each beverage dispensed and the water pump means dispense a predetermined amount of water into the beverage container for each beverage dispensed, the syrup pump means including:

a plurality of syrup containers each containing a different syrup;

a plurality of syrup pumps, each syrup pump having an inlet coupled to a different syrup container of the plurality of syrup containers and having an outlet coupled to a location adjacent the beverage container; and the cycle means and selector activating the syrup pump of the plurality of syrup pumps associated with the selected syrup at a predetermined time relative to the time of dispensing of water by the water supply means, said predetermined relative time being different for different pumps of the plurality of syrup pumps.

3. The apparatus of claim 2 in which the cycle means further comprise:

a plurality of switches, each switch of the plurality of switches being coupled to a different one of the syrup pumps;

a cycle timer coupled to each switch of the plurality of switches and operable to close each said switch at a predetermined time relative to the time of dispensing of water by the water supply means, the time of closing one of said switches being independent of the time of closing of the others of said switches.

4. The apparatus of claim 3 in which the cycle means further comprises full cycle means associated with each syrup pump for maintaining each syrup pump in an energized condition for a complete cycle of the pump once said pump has been energized initially.

5. In a flavored-beverage dispensing apparatus having means for dispensing a beverage selected from a plurality of beverages, each said beverage containing a preset flavor and water type, the improvement which comprises:

a. a plurality of syrup pump means for supplying syrup associated with the flavor of the selected beverage, each said syrup pump means being operable to supply a different syrup of the plurality of syrups when activated;

b. a plurality of water pump means for supplying the type of water for the selected beverage, each said water pump means being operable to supply a different water type when activated;

c. a selector switch;

d. a circuit board receiving said selector switch and having a plurality of positions to which the selector switch may be moved, each position to which the selector switch may be moved, each position of the plurality of positions corresponding to a different beverage of the plurality of beverages selected from, 1. each said position including a first conductive path coupled to the syrup pump means for the beverage for that position and 2. each said position having a second conductive pad coupled to the water pump means for the beverage for that position, 3. the selector switch being operable to coupled electrical power to the first and second pad at each said position of the plurality of positions activating the syrup pump means and water pump means for that position; and e. presetable cycle means associated with each said pump means for adjustably setting the timing of a cycle for said pump means.

6. The apparatus of claim 5 in which the syrup pump means dispense a predetermined amoung of a selected syrup into a beverage container for each beverage dispensed and the water pump means dispense a predetermined amount of water into the beverage container for each beverage dispensed, the syrup pump means including:

a plurality of syrup containers each contaiining a different syrup;

a plurality of syrup pumps, each syrup pump having an inlet coupled to a different syrup container of the plurality of syrup containers and having an outlet coupled to a location adjacent the beverage container; and the cycle means and selector switch activating the syrup pump of the plurality of syrup pumps associated with the selected syrup at a pre-determined time relative to the time of dispensing of water by the water supply means, said pre-determined relative time being different for different pumps of the plurality of syrup pumps.

7. The apparatus of claim 6 in which the beverage dispensing apparatus is a carbonated water and still water flavored-beverage dispensing apparatus and which further comprises:

a carbonator having an input for still water and a carbonated water output;

a first conduit coupled to the input of the carbonator;

still water supply means for coupling still water through the first conduit to the carbonator input to maintain the water level in the carbonator; and priority means for interrupting still water flow in the first conduit and for diverting the still water flow to the beverage container during the dispensing of a beverage containing still water.

8. The apparatus fo claim 6 in which the cycle means further comprise:

a plurality of switches, each switch of the plurality of switches being coupled to a different one of the syrup pumps;

a cycle timer coupled to each switch of the plurality of switches and operable to close each said switch at a predetermined time relative to the time of dispensing of water by the water supply means, the time of closing one of said switches being independent of the time of closing of the others of said switches.

9. The apparatus of claim 8 in which the cycle means further comprises full cycle means associated with each syrup pump for maintaining each syrup pump in an energized condition for a complete cycle of the pump once said pump has been energized initially.

10. In a flavored-beverage dispensing apparatus having means for dispensing a beverage of a flavor selected from a plurality of flavors and having selector means for selecting the flavor of the beverage to be dispensed, the improvement which comprises selector means including:

a circuit board mounted in the apparatus having a first conductive path coupled from a source of electrical power and having a first plurality of conductive pads separate from the first conductive path;

selector switch means engaged with said circuit board for selectively coupling the first conductive path to a pad of the first plurality of conductive pads;

a first plurality of conductive arms, each conductive arm having a first end coupled to a different pad of the first plurality of conductive pads and having a second end coupled through a conductive path to a pump in the beverage dispensing means associated with the flavored-beverage selected;

a second plurality of conductive arms, each conductive arm of the second plurality of conductive arms having a first end coupled to a different pad of the first plurality of conductive pads; and a plurality of conductive paths each coupled to a different means for providing a type of water flow for a selected beverage in response to energization by electrical power, the second end of each arm of the second plurality of conductive arms being coupled to a selected path of said plurality of conductive paths.

* * * * *